US006301731B1

(12) United States Patent
Jakubowski et al.

(10) Patent No.: US 6,301,731 B1
(45) Date of Patent: Oct. 16, 2001

(54) INFANT ACTIVITY PANEL

(75) Inventors: Chris D. Jakubowski, Rutland; Scott S. Jakubowski, Castleton; Todd M. Jakubowski, Rutland, all of VT (US)

(73) Assignee: Vermont Juvenile Furniture, West Rutland, VT (US)

( * ) Notice: Subject to any disclaimer, the term of this patent is extended or adjusted under 35 U.S.C. 154(b) by 0 days.

(21) Appl. No.: 09/255,574

(22) Filed: Feb. 22, 1999

(51) Int. Cl.[7] ..... A47D 15/00

(52) U.S. Cl. ..... 5/658; 5/93.1; 5/98.1; 5/946; 5/907; 446/227

(58) Field of Search ..... 5/93.1, 98.1, 99.1, 5/663, 907, 908, 946, 658; 446/227

(56) References Cited

U.S. PATENT DOCUMENTS

| | | | | |
|---|---|---|---|---|
| D. 310,929 | | 10/1990 | Blau | D6/602 |
| D. 343,756 | | 2/1994 | Sher | D6/601 |
| D. 365,486 | | 12/1995 | Perry | D6/597 |
| D. 366,368 | | 1/1996 | McCarthy | D6/333 |
| 949,389 | * | 2/1910 | Almgren | 5/93.1 |
| 2,078,022 | | 4/1937 | Roemer | 46/1 |
| 2,128,978 | * | 9/1938 | Akin | 5/946 X |
| 2,327,253 | * | 8/1943 | Eisel | 5/93.1 X |
| 2,461,682 | * | 2/1949 | De Ferrari | 446/227 |
| 2,471,762 | * | 5/1949 | Merrett | 5/658 X |
| 2,600,556 | * | 6/1952 | Malm | 5/93.1 |
| 3,120,721 | | 2/1964 | Bukatman et al. | 46/202 |
| 3,241,158 | * | 3/1966 | Berl | 5/946 |
| 3,848,277 | * | 11/1974 | Reguitti | 5/93.1 X |
| 4,594,072 | * | 6/1986 | Cowell | 446/227 |
| 4,681,195 | | 7/1987 | Trahan et al. | 190/2 |
| 4,726,084 | | 2/1988 | Keserovich et al. | 5/417 |
| 4,935,976 | * | 6/1990 | Milman | 5/93.1 |
| 4,968,279 | * | 11/1990 | Smith | 5/907 X |
| 5,035,013 | | 7/1991 | Bloom | 5/420 |
| 5,088,139 | | 2/1992 | Bloom | 5/420 |
| 5,103,514 | | 4/1992 | Leach | 5/417 |
| 5,167,565 | | 12/1992 | Metcalf | 446/491 |
| 5,370,460 | | 12/1994 | Nelson | 383/4 |
| 5,429,541 | | 7/1995 | Landon | 446/70 |
| 5,454,125 | | 10/1995 | Ratkowski | 5/417 |
| 5,546,620 | | 8/1996 | Matthews | 5/655 |
| 5,881,408 | * | 3/1999 | Bashista et al. | 5/663 |
| 6,026,528 | * | 2/2000 | Pina | 5/946 X |
| 6,113,454 | * | 9/2000 | Mitchell | 446/227 |

FOREIGN PATENT DOCUMENTS

| | | | |
|---|---|---|---|
| WO 94/09689 | 5/1994 | (WO) | A47G/9/00 |

* cited by examiner

*Primary Examiner*—Michael F. Trettel
(74) *Attorney, Agent, or Firm*—Fish & Richardson P.C.

(57) ABSTRACT

An infant activity device includes a base, a support member and an upper member. The support member extends from the base to the upper member to support the upper member above the base. An infant activity panel is attachable between the upper member and the base. An infant activity fastener also is attachable to the infant activity device to secure, for example, a toy.

28 Claims, 5 Drawing Sheets

INFANT ACTIVITY PANEL

BACKGROUND

This invention relates to infant activity, especially to infant activity devices, for example, "play pens", that accommodate an infant during periods of activity or other leisure.

Devices are know that provide an area for an infant to play, eat, or sleep. Cribs, "play pens", mats, or other play areas provide convenient locations for the infant, especially when a parent is not directly attending to the infant. However, without additional stimuli, the infant may not be encouraged to perform physical or mental activities.

SUMMARY

One aspect of the invention is an infant activity device, that includes a base, e.g., a floor of a play pen, and an upper member supported above the base, e.g., a rail of a play pen. The device also includes a removable panel that is attached to the infant activity device.

Preferred embodiments of this aspect of the invention may include one or more of the following features.

The infant activity device includes two removable panels. Each panel has an upper edge having with two fasteners that is attached to the upper member. The removable panel has two major surfaces each having visual exhibits. The visual exhibits include, for example, images and activity devices such as toys and reflective surfaces. Each of the visual exhibits can be displayed toward an infant in the direction of the infant's activity by attaching a corresponding one of the two fasteners to the upper member, and, thus, orienting one or the other major surface in the direction of activity.

Each panel includes a padding layer disposed between two sheets. An activity device can also be disposed between the sheets and within the padding layer. The surface that covers the activity device can be visually distinct from the surrounding surface.

Another aspect of the invention includes an infant activity panel that attaches to an infant leisure device along an edge of the panel. The infant activity panel is removable and has a major surface with a visual exhibit.

Preferred embodiments of this aspect can include one or more of the following features.

The removable infant activity panel is reversible, and includes two major surfaces with visual exhibits. Each major surface can face in the direction of activity when the panel is fastened to the infant leisure device in a corresponding position. The visual exhibit of each surface can include images and activity devices such as toys, including squeaker devices, or reflective surfaces.

A third aspect of the invention includes an infant activity fastener that can be attached to an infant leisure device. The infant activity fastener has a flexible strip. One end of the flexible strip can be attached to a support member of the infant leisure device. The other end of the flexible strip can be attached to the flexible strip to form a loop portion.

Preferred embodiments of this aspect can include one or more of the following features.

One end of the flexible strip can be permanently attached to the support member of an infant leisure device. The second end of the flexible strip includes a hook and loop type fastener.

One or more aspects of the invention may include one or more of the following advantages.

The devices promote physical activity. The devices promote mental activity. The devices facilitate infant physical development. The devices facilitate infant mental development. The devices provide visual, audio, and/or other stimuli. The devices are entertaining. The devices contribute to a wholesome environment. The devices enhance child safety.

BRIEF DESCRIPTION OF THE DRAWINGS

The foregoing features and other aspects of the invention will be described in further detail by the accompanying drawings, in which.

DETAILED DESCRIPTION

Figure 1:
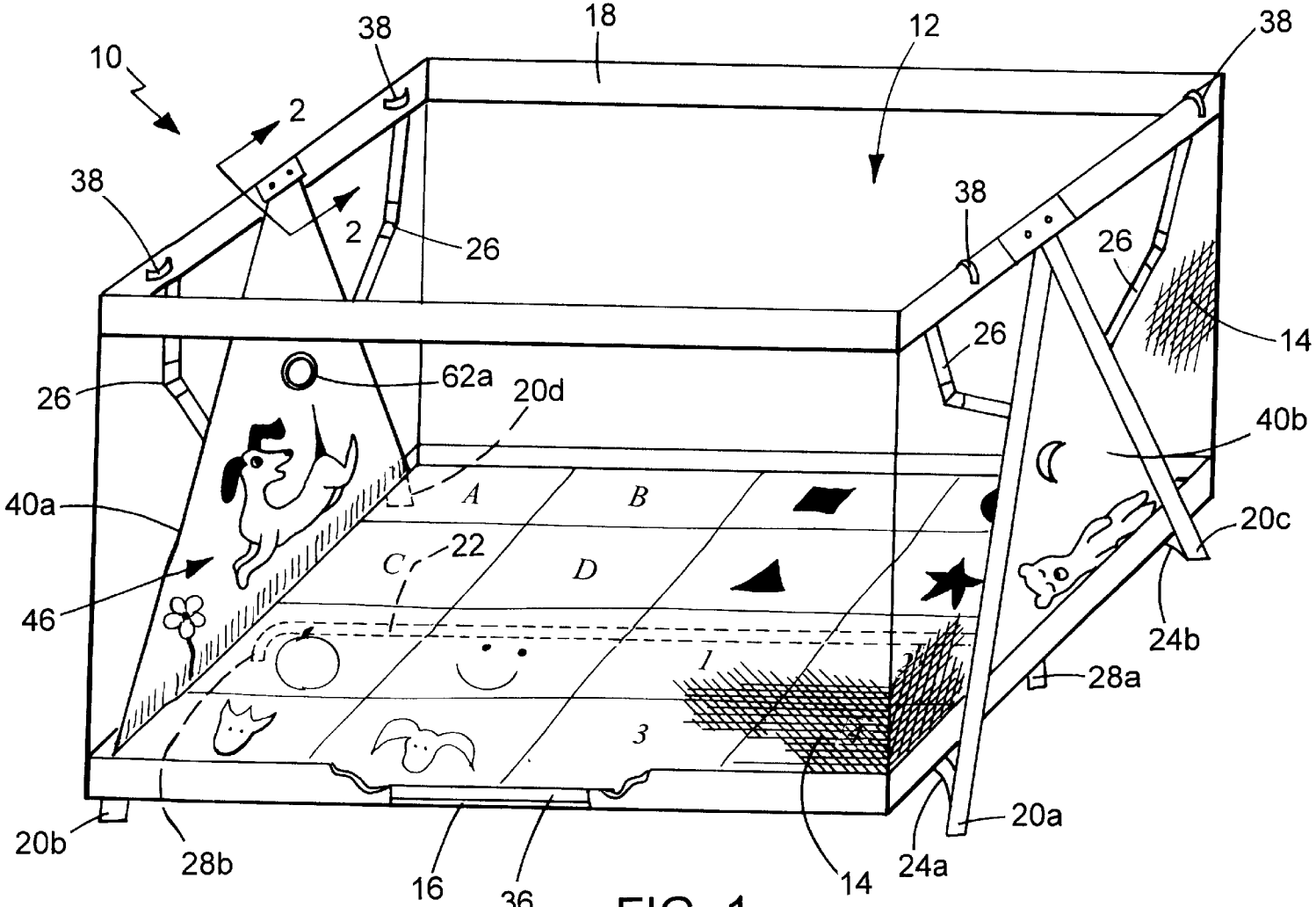
FIG. 1 is a perspective view of an infant activity device including two infant activity play panel devices and four infant activity fastener devices.

Referring to FIG. 1, an infant activity device 10 provides an environment that promotes infant activity and development. As shown, the activity device 10 includes a play area 12 that is bounded by a netting material 14. The netting material 14 extends vertically from a floor 16 of play area to a rail 18. The netting material 14 and the rail 18 extend completely around, and enclose, the play area 12.

The infant activity device 10 includes a collapsible structural framework that includes the floor 16, the rail 18, four main support legs 20*a*–20*d*, a crossbeam 22, two leg support beams 24*a*–24*b*, and four rail support arms 26. Because of the orientation of the activity device 10 in FIG. 1, the leg 20*d* and the crossbeam 22 are shown in phantom through the floor 16; the leg support beams 24*a*–24*b* are only partially visible. When the infant activity device 10 is in an assembled position, the floor 16 rests on the leg support beams 24*a*–24*b* and the cross beam 22. The cross beam 22 extends underneath the floor 16. The end sections of the crossbeam 22 bend downward to form two legs 28*a*–28*b*. The leg support beams 24*a*–24*b* are attached to the main support legs 20*a*–20*d* by rivets. Each of the beams 24*a*–24*b* extends between two corresponding legs 20*a*–20*d*: the beam 24*a* extends between the legs 20*a*, 20*b* and the beam 24*b* extending between the legs 20*c*, 20*d*. The four rail support arms 26 extend from corresponding legs 20*a*–20*d* to the rail 18 in an outward bending position to support the rail 18. The floor 16 is split in two sections along a center line and coupled together with hinges (not shown).

When the infant activity device 10 is in a collapsed position, both the floor 16 and the rail 18 fold in half.

The rail support arms 26 fold to an inward bending position that allows each half of the rail 18 to collapse downward, while the floor 16 folds upward from the middle. Thus, the infant activity device 10 forms a compact and portable structure approximately the size of a suitcase.

The infant activity device 10 is designed to promote physical and mental activity of the infant. The activity device 10 includes an activity mat 36, four activity fasteners 38 (described in greater detail in conjunction with FIGS. 5–6), and two infant activity panels 40*a,* 40*b* (described in greater detail in conjunction with FIG. 3A–3B). The rail 18 includes two pads 32 that provide fastening mechanisms for the activity panels 40*a*–40*b*.

As shown, the infant activity device 10 is a "play pen" that securely and safely retains an infant in the play area 12. The infant can engage in several leisure activities including playing, sleeping, and eating. Alternatively, an infant activity device could be a crib, a chair, a device that provides an unenclosed play area, or another type of device that also facilitates infant leisure activities.

The infant activity mat 36 provides a padded surface across the entire area of the floor 16. The infant can play on the activity mat 36 within the play area 12. In addition, the activity mat 36 is removable from the play area to, e.g., allow the infant to play on the mat 36 outside the play area 12 or allow a parent to wash the mat 36. The activity mat 36 is reversible and includes two displays: one display on each major surface. The display on an upper facing surface can include primary colors and relatively more complex shapes to promote activity in older infants, i.e., toddlers. The display on a downward facing surface (not shown) can include black, white and red shapes, such as smiley faces, to promote activity in early infants.

The infant activity panels 40*a,* 40*b* provide visual exhibits that can include a printed image such as a cartoon and that can include one or more activity devices such as toys connected externally or integrated into the panel. For example, the activity panel 40*a* includes a visual exhibit 46 that is a cartoon image depicting a dog bounding after a ball across a field of grass and flowers; the activity panel 40*a* also includes an activity item 62*a* that is a small squeaker toy located beneath the image of the ball so that a sound emanates when the infant presses the image of the ball. The squeaker toy is a round diaphragm containing a reed that makes a squeaking sound when pressed with sufficient force. An opposing side of the activity panel 40*a* (not shown) would preferably include a different visual exhibit, such as an image of the dog at rest.

The two infant activity panels 40*a*–40*b* are disposed at opposing ends of the play area 12. The panels 40*a*–40*b* are attached to the rail 18 along an upper edge 42 of each panel 40*a*–40*b*. The rail 18 forms an upper support for each activity device. The structural combination of the main support legs 20*a*–20*d* and the support arms 26 supports the rail 18 above the floor 16.

Figure 2:
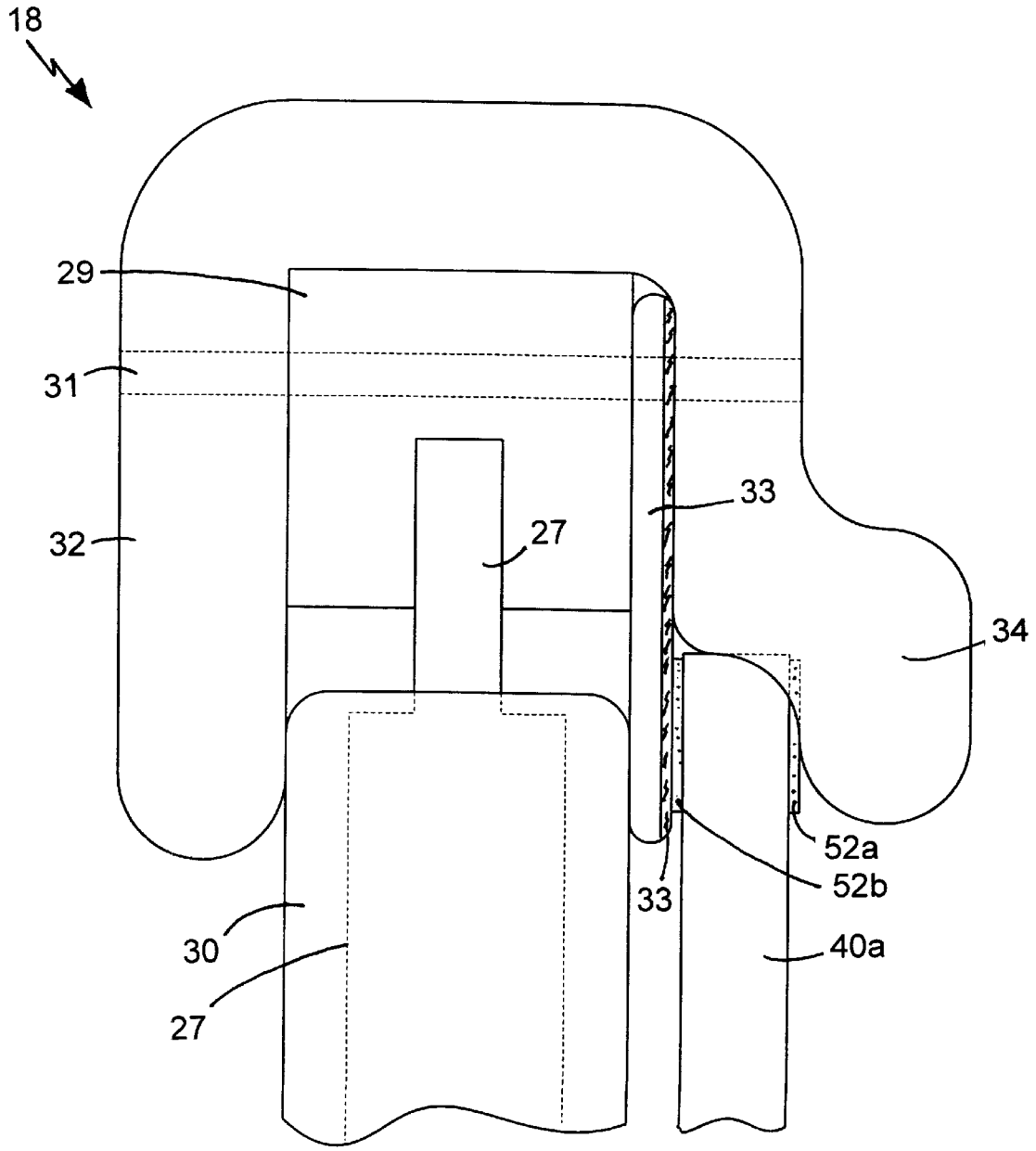
FIG. 2 is a side view of the infant activity device from the line 2—2 of FIG. 1 showing a rail partially folded downward and showing a connection between an infant activity play panel device and a fastener.

Referring now to FIG. 2, the rail 18 includes two interior metal bars 27, two plastic hinges 29, two padded cushions 30, and two pads 32. The rail 18 is shown partially folded downward to expose the plastic hinge 29 and show the connection between the hinge 29 and the metal bar 27 (shown partially in phantom). The interior metal bars 27 extend through the center of the rail 18 to provide structural support. The interior metal bars 27 extend about the periphery of the infant activity device 10 and connect to the hinges 29 such that one hinge 29 is opposite the other hinge 29. The metal bars are arranged symmetrically about the infant activity device 10.

The padded cushions 30 cover the metal bars 27. Each padded cushion 30 includes an inner padding layer of polyurethane to protect the infant from impact with metal bars 27. The padded cushion 30 also includes an outer vinyl cover over the inner layer that secures the netting material 14 to the rail 18.

The pads 32 are located at opposite ends of the infant activity device 10 (as shown in FIG. 1) where the main support legs 20*a*–20*d* and the metal bars 27 connect to the hinges 29. Each foam pad 32 covers one of the corresponding hinges 29. Similar to the padded cushions 30, each pad 32 is a vinyl covered foam pad. The pads 32 provide protective padding over the hinges 29 which are the portions of device 10 where the rail 18 folds downward and the legs 20*a*–20*d* fold together.

In addition, the pads 32 of the activity device 10 are used to attach the activity panels 40*a,* 40*b* to the rail 18. For example, as shown in FIG. 2, the pad 32 secures the infant activity panel 40*a* to the rail 18. The pad 42 is secured to the hinge 29, e.g., by two rivets 31. Only one rivet 31 is shown, in phantom, in the side view of FIG. 2. The rivets 31 extend entirely through the pad 32 and the hinge 29.

The pad 32 includes a fastener 33, e.g., a strip of Velcro® hook fastener material. The hook fastener 33 extends between the hinge 29 and a flap 34 of the pad 32. The rivets 31 secure the fastener 33 in place. The fastener 33 is located within the periphery of the infant activity device 10 and the hooks of the hook fastener 33 face toward the center of the infant activity device.

In contrast, each side of the activity panel 40*a* includes a reciprocal fastener 52*a,* 52*b* along the upper edge 42. Each reciprocal fastener 52*a,* 52*b* is, e.g., a strip of Velcro® loop fastener material that can engage the hook fastener 33. Thus, a parent can attach the activity panel 40*a* to the rail 18 by securing one of the reciprocal fasteners 52*a* of the upper edge 42 to the edge 34. Also, the panel can be removed by pulling the fasteners 33, 52*a* apart, and the panel can be reversed by fastening the opposing reciprocal fastener 52*b* to the fastener 33. When, e.g., fastener 52*a* is fastened, the flap 34 of pad 32 hides the upper edge 42 of panel 40*a,* including the unfastened loop fastener 52*b*.

Alternatively, other fastening mechanisms could be used such as snaps, buttons, ties, a magnetic strip, or other mechanisms. In addition, an alternate mechanism for reversing the activity panel could include fasteners that are similar to fasteners 33 but that have hook fastener material on two sides, rather than on a single side. In such a configuration, each activity panel could include only a single fastener 52*a,* without an additional fastener 52*b* on the opposite side. When the panel is reversed, fastener 52*a* would attach to the hook fastener material on the other side of the fastener on the pad.

The panels 40*a*–40*b* provide additional padding to protect the infant from impact with the legs 20*a*–20*d*. The height of each panel 40*a*–40*b* is approximately equal to the distance from the floor 16 to the rail 18. Therefore, when the upper edge 42 is attached to the edge 34, the base edge 48 extends generally parallel to and along the floor 16. the panel 40*a* has a shape that corresponds to the divergence of each pair of support legs 20*a*–20*d* that are located at the ends of the play area 12. Thus, when attached to corresponding edges 34, the panel 40*a* covers the legs 20*b,* 20*d,* and the panel 40*b* covers the legs 20*a,* 20*c*.

Alternatively, each panel 40*a,* 40*b* could be attached at other locations within the infant activity device 10. Also, each panel could be used either inside or outside of the infant activity device 10, e.g., as a play mat or when propped against or attached to another support member, e.g., the netting material 14 or a chair.

Because the netting material 14 encloses the play area 12, the panels 40*a*–40*b* are not required to prevent the infant from exiting the play area 12. Therefore, the base edge 48 of each panel 40*a*–40*b* need not attach to any other part of the device 10. Alternatively, the base edge 48, another edge, or another portion of each panel 40*a*–40*b* could be attachable to, e.g, the floor 16 or a side of the infant activity device 10. However, the infant activity device 10 is designed to prevent harm to the infant, and alternate configurations preferably prevent the infant from becoming trapped behind the infant activity panels 40*a,* 40*b*.

Figure 3B:
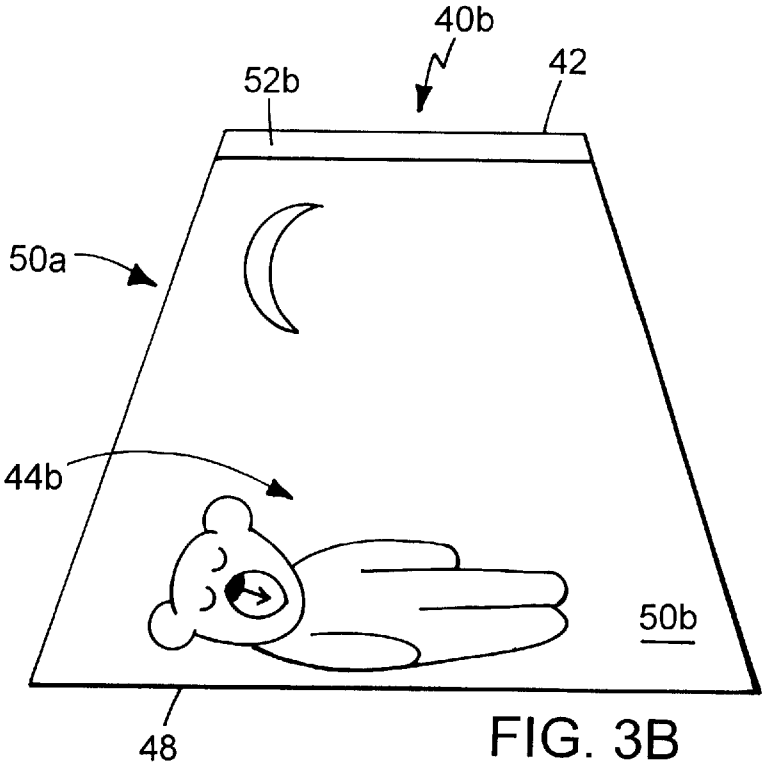
FIG. 3B is a plan view of an opposite side of the infant activity play panel device of FIG. 3A.
Figure 3A:
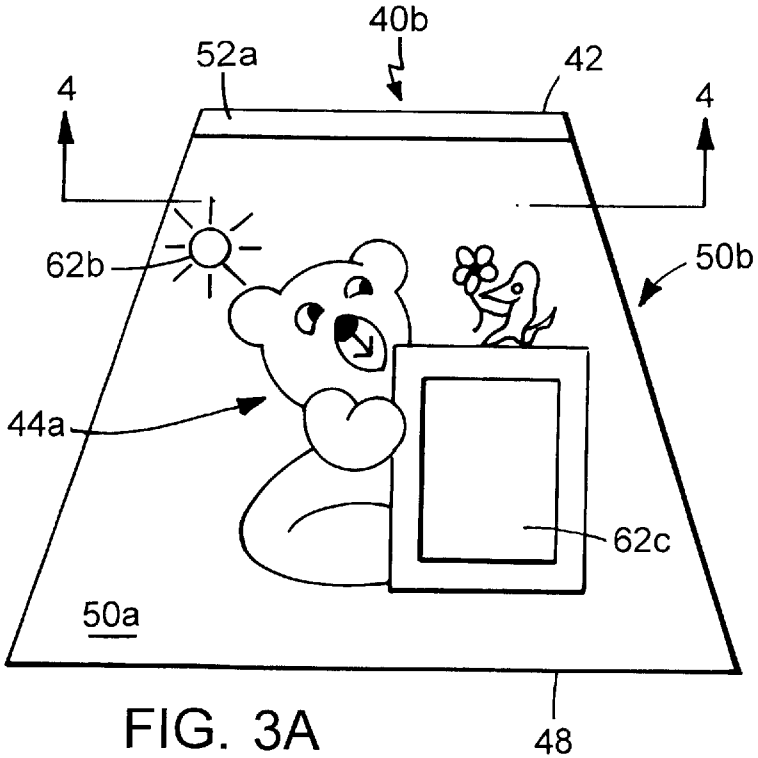
FIG. 3A is a plan view of one of the infant activity play panel devices of FIG. 1.

Referring to FIGS. 3A and 3B, the activity panel 40*b* is representative of activity panels that may by used in conjunction with the infant activity device 10. The activity panel is generally planar with two opposing major surfaces 50*a*–50*b* on opposite sides of the panel 40*b*. The shape of each major surface 50*a*–50*b* of the panel 40*b* is a parallelogram with the longer base edge 48 and the shorter upper edge 42.

Each major surface 50*a*–50*b* includes a corresponding visual exhibit 44*a,* 44*b*. For example, major surface 50*a* includes images and additionally includes two activity items 62*b*–62*c* to encourage activity by the infant. Major surface 50*b* includes only images.

Preferably, each visual exhibit of each activity panel is distinct. For example, on the activity panel 40*b,* the visual exhibit 44*a* includes a cartoon image depicting a brown bear holding a frame with a small mouse poised upon the frame and holding a flower; the visual exhibit 44*b* includes a similar cartoon of the bear sleeping under a moonlit sky. The images of visual exhibits 44*a,* 44*b* are formed by a standard vinyl printing process prior to assembly of the activity panel 40*b*. The activity item 62*b,* which is similar to activity item 62*a,* is a squeaker toy placed underneath the image of a sun. The activity item 62*c* of the visual exhibit 44*a* is a mirror that provides a reflective surface to allow the infant to view herself or other objects.

Other combinations of visual exhibits having images and/or activity items are possible. For example, electronic devices can be incorporated into activity panels that allow, e.g., light, music, or other sounds, to emanate when an activity item is engaged by the infant or otherwise activated. Other types of toys, such as rattles, spinning wheels, or balls, can also be incorporated. Detachable toys can also be incorporated, e.g., by placing hook and loop fasteners about the panels and/or by including sensors that generate a response when the detachable toy engages the correct location.

In addition, processes other than a vinyl printing process can be used to create the visual image of the exhibit. For example, activity panels can include vinyl images, such as shapes and/or figures. The images can be permanently attached to the activity panels, e.g., by sewing or heat sealing, or the images can be detachable to allow an infant to manipulate the items. To accommodate the images, the activity panels could include shallow recesses in both the foam padding and the overlying vinyl sheet. The recesses could be created by a heat sealing process. Each recess could accommodate a particular image, e.g., a shape of a circle or a figure of a mouse with a flower. Thus, the vinyl images could provide both an image and an activity item of the exhibit. Preferably, the exhibit would also include additional associated devices, e.g., an electronic music device that operates when a shape is place into the recess of the panel.

In both of the panels 40*a* (FIG. 1) and 40*b* (FIG. 3A), the activity items 62*a*–62*c* are incorporated in a manner intended to maintain a safe environment and, e.g., prevent the infant from biting on the edge of the activity items. For example, the reflective surface of the activity item 62*c* is aligned with the frame of the visual exhibit 44*a* on the major surface 50*a*. The reflective surface is, e.g., a metalized plastic such as a reflective mylar. A second layer of vinyl, e.g., a double polished clear vinyl, is placed over the reflective surface. The reflective surface and the two layers of vinyl are heat sealed so that the reflective surface is completely encased in vinyl and is permanently secured to the activity panel 40*b*.

Similarly, to incorporate the activity items 62*a*–62*b* of the respective activity panels 40*a* (FIG. 1) and 40*b* (FIG. 3A), the squeaker toy is placed into a hole that is formed in the foam prior to assembly. The squeaker toy is heat sealed within the foam. Subsequently, a vinyl sheet 54 (FIG. 4) is placed over the squeaker toy and is heat sealed to secure the vinyl sheet across the toy. The images of the red ball and the sun cover and adhere to the squeaker toy.

In addition, the portion of the visual exhibits that cover the squeaker toys are visually distinct from the adjacent images. For example, the sun is visually distinct from blue sky to encourage the infant to engage the ball and, consequently, the squeaker toy.

The visual exhibits 44*a,* 44*b* on the activity panel 40*b* are complimentary. As discussed above, the activity panels 40*a*–40*b* are reversible: each upper edge 42 includes two strips of hook fastener material with one strip on each corresponding major surface 50*a*–50*b*. Thus, either major surface 50*a*–50*b* can be oriented in a direction of activity of the infant.

Additionally, the visual exhibits 44*a,* 44*b* of the activity panel 40*b* compliment each other. For example, the visual exhibit 44*a* is brightly decorated to encourage activity when facing the direction of activity the infant, e.g., into the play area 12. On the other hand, the visual exhibit 44*b* is subdued to encourage a calming response, such as may be desired when the infant is placed in the play area 12 to nap. Thus, for example, the visual exhibit 44*b* includes an image of a sleeping bear as well a moonlit background. Thus, the activity panel 40*b* can be turned to provide the desired environment.

Many alternative combinations are possible. For example, the opposing visual exhibits can include lively and calming scenes to encourage activity and rest respectively, such as a playing dog and a sleeping dog. One or both opposing visual exhibits can incorporate a scene only without incorporating an activity item. The opposing visual exhibits can be directed to young infants and toddlers respectively to accommodate development. The opposing displays can provide a variety of scenes to encourage activity in infants of the same general age. One or both of the visual exhibits can be blank. Additional activity panels can be included or purchased to increase the available variety.

Figure 4:
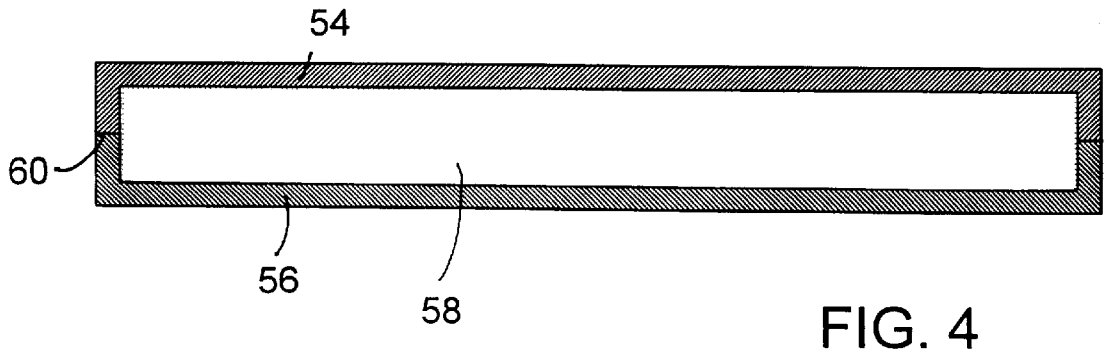
FIG. 4 is a cross sectional view of the infant activity play panel device viewed across line 4—4 of FIG. 3A.

Referring to FIG. 4, the activity panel 40*b* is formed of, e.g., vinyl and foam. In one exemplary construction, two 12-gauge vinyl sheets 54, 56 surround a polyurethane foam section 58. Lighter gauge vinyl sheets could be used. However, the Juvenile Product Manufacturing Association specifies that, for safety reasons, 12-gauge or heavier vinyl should be used in conjunction with products for infants. The edges of the vinyl sheets 54, 56 are heat sealed to provide a seam 60 around the perimeter of the panel 40*b*. The vinyl sheets 54, 56 form the major surfaces 50*a*–50*b* when the activity panel 40*b* is assembled.

Figure 5:
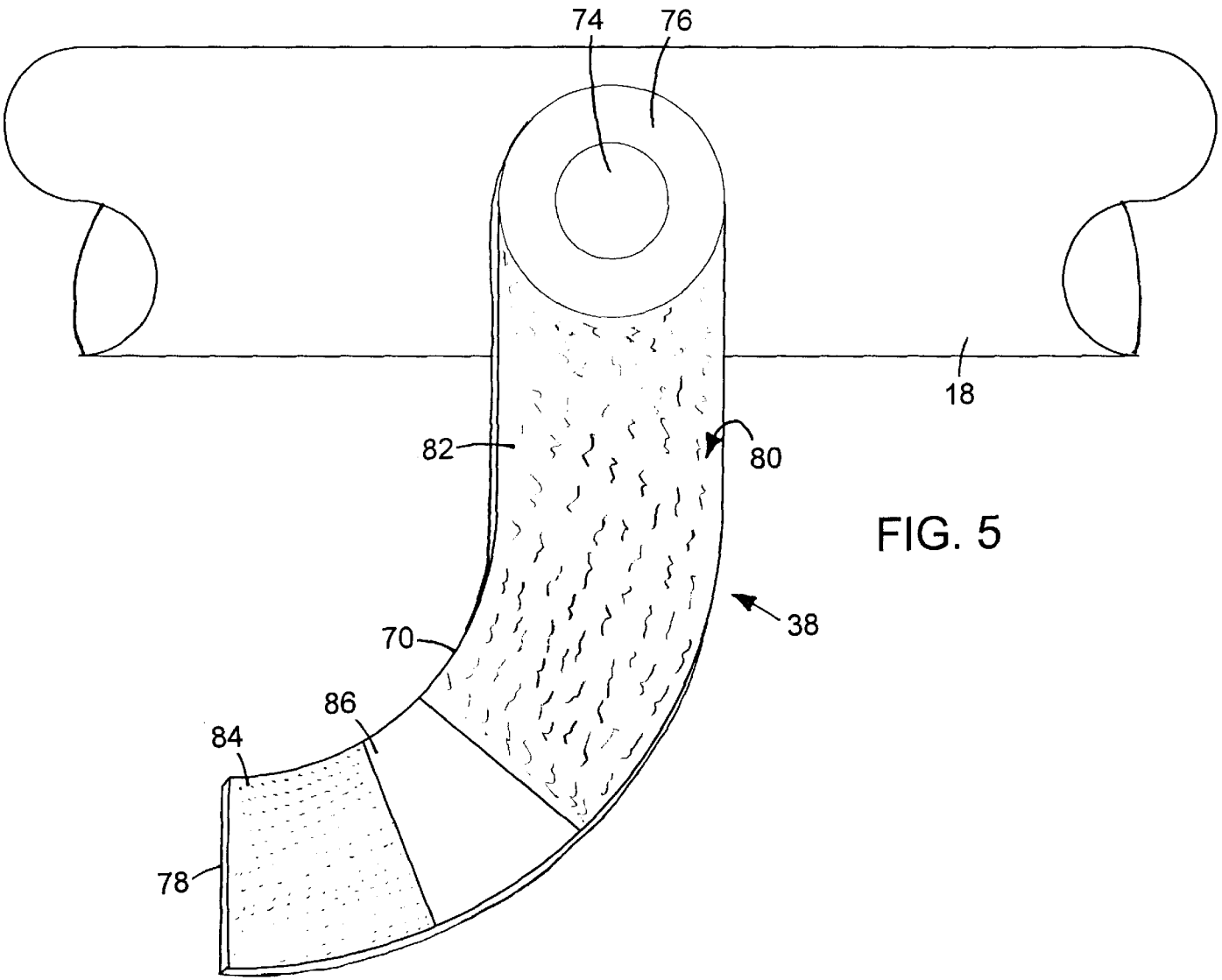
FIG. 5 is a front view of an infant activity fastener of the infant activity device of FIG. 1 in an unfastened position.

Referring now to FIGS. 1 and 5, four activity fasteners 38 are attached to rail 18 (FIG. 1) near four corresponding corners of the infant activity device 10. Each activity fastener 38 allows a parent to attach toys that are appropriate for the age of the infant. Each activity fastener 38 includes, e.g., a flexible plastic strip 70 that is permanently attached by a fastener 72, e.g., a rivet 74 and a washer 76, at one end to the rail 18. For each activity fastener 38, the rivet 74 extends through the plastic washer 76, the flexible strip 70, and the padded cushion 30. The rivet 74 also extends into the rail 18, which is hollow, and expands to secure the flexible strip 70 between the rail 18 and the washer 76. A snap can be used to semi-permanently attach the infant activity fastener 38 to the rail 18.

Figure 6:
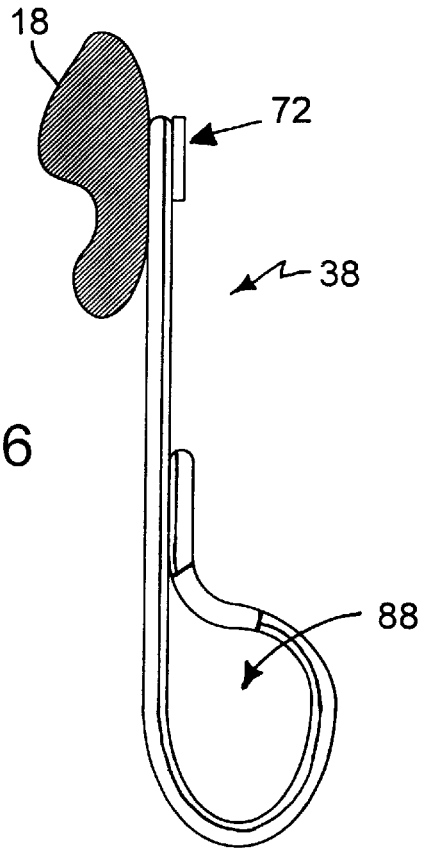
FIG. 6 is a side view of the infant activity fastener of FIG. 5 in a fastened position.

A second end 78 of each fastener 38 is not secured to the rail 18. Rather, the second end 78 is free and can be extended through a toy, such as a rattle, to secure the toy to infant activity device 10. Referring also to FIG. 6, to secure the toy, the flexible strip 70 is folded back on itself, with the free end 78 attached to a portion of the flexible strip 70 to form a loop 88 (FIG. 6). For example, the flexible strip 70 is, e.g., 0.6250" in width and 4.9295" in length. One side 80 of flexible line includes a hook and loop fastening mechanism. The flexible strip 70 includes, e.g., a portion 82 of loop fastener material that is 4.1420" in length. At the free end 78 and along the same side 80, the flexible strip 70 includes, e.g., a portion 84 of hook fastener material that is 0.4125" in length. The interim portion 86 of the flexible strip 70, which is 0.3750" in length, includes an ultrasonic weld that connects the loop portion 82 and the hook portion 84. When flexible strip 70 is folded back upon itself, the hook portion 84 engages the loop portion 82 to secure the toy within the resulting enclosed loop 88 (FIG. 6).

The activity fasteners 38 are designed to reduce the likelihood of harm to the infant. For example, the length and width of the flexible strip 70 are chosen to make it difficult for a parent to secure a toy with a knot in the flexible strip 70 that could catch on the infants clothing or otherwise ensnare the infant. In addition, the fastener is constructed to break away at a force of five to seven pounds. The hook and loop portions 82, 84 are chosen so that they do not bind tightly, and, thus, are designed to prevent harm to the infant if the infant is caught on the fastener.

Other embodiments are within the scope of the following claims.

For example, a retrofit kit could be used to incorporate the infant activity panels 40*a*, 40*b* into existing play pens or other infant leisure devices. For example, such a kit could preferably include a set of bolts, rather than rivets, to attach a pad or other fastening means to the existing device. Alternatively, an adhesive surface could be used to attach the pad or other fastening means to the existing device.

Such retrofit devices could include a loop fastener that faces away from the play area on an upper surface of the fastening means. With such a fastening means, the infant activity panel could include a reciprocal hook fastener that extends from the play area and wraps over the top of the pad to attach to the loop fastener on the other side of the pad. In addition, the loop fastener could be attached to a flap that folds up to expose the loop fastener when the infant activity panel is attached and that folds down to hide the fastener when the infant activity device is not attached.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An infant activity device, comprising:

a base;

an upper member supported above the base;

a flexible activity panel attached to at least one of the base and the upper member;

an activity fastener attached to the upper member, the activity fastener comprising:

a flexible strip a first end attachable to a support member of the infant leisure device, a second free end; and a hook and loop type fastener for attaching the second end to the flexible strip to form a loop portion the hook and loop type fastener detaching the second end from the flexible strip when subjected to a load greater than a threshold value to avoid injury to the infant.

2. The infant activity device of claim 1 wherein the panel further comprises an upper edge having a fastener attached to the upper member.

3. The infant activity device of claim 1 wherein the panel further comprises a first major surface having a first visual exhibit.

4. The infant activity device of claim 3 wherein the panel further comprises a second major surface having a second different visual exhibit.

5. The infant activity device of claim 4, wherein the panel is a removable panel and is reversible between a first orientation and a second orientation, the first major surface facing in a direction of the infant when the removable panel is attached in the first orientation, the second major surface of the panel facing in the direction of the infant when the removable panel is attached in the second orientation.

6. The infant activity device of claim 3 wherein the visual exhibit comprises an image.

7. The infant activity device of claim 3 wherein the visual exhibit comprises an activity item.

8. The infant activity device of claim 1 wherein the panel comprises:

a first major surface lying opposite a second major surface, and an activity item disposed between the first major surface and the second major surface.

9. The infant activity device of claim 8 wherein the first major surface comprises a first portion disposed adjacent to the activity item, the first portion covering the activity item, the first portion being visually distinct from an adjacent portion of the first major surface.

10. The infant activity device of claim 1 wherein the panel comprises:

a first sheet, a second sheet, and a padding layer disposed between the first and second sheets.

11. The infant activity device of claim 1 further comprising a second removable panel attachable between the upper member and the base, an upper edge of the panel attachable to the upper member.

12. The infant activity device of claim 1 further comprising:

an activity fastener including a flexible strip having:

a first end attached to at least one of the base and the upper member, a second free end, and a hook and loop type fastener for attaching the second free end to the flexible strip to form a loop portion, the hook and loop type fastener detaching the second free end from the flexible strip when subjected to a load greater than a threshold value to avoid injury to the infant.

13. The infant activity panel of claim 12 further comprising a toy.

14. The infant activity panel of claim 13 wherein the toy is a squeaker device.

15. The infant activity panel of claim 13 wherein the toy is a reflective surface.

16. The infant activity device of claim 1, wherein the panel is a removable panel and is reversible between a first orientation and a second orientation, the panel having:

the first major surface facing in a direction of the infant when the removable panel is attached in the first orientation to reveal the visual exhibit, a second major surface having a second different visual exhibit, the second major surface facing in the direction of the infant when the removable panel is attached in the second orientation to reveal the second visual exhibit.

17. The infant activity device of claim 1, wherein the panel is removable.

18. The activity device of claim 1, wherein the panel comprises at least one of foam and vinyl sheets.

19. The activity device of claim 18, wherein the panel comprises vinyl sheets that are heat sealed to provide a seam around a perimeter of the panel.

20. An activity fastener for attachment to an infant leisure device, comprising:

a flexible strip having:

a first end attachable to a support member of the infant leisure device, a second free end, and a hook and loop type fastener for attaching the second end to the flexible strip to form a loop portion, the hook and loop type fastener detaching the second end from the flexible strip when subjected to a load greater than a threshold value to avoid injury to the infant.

21. The infant activity fastener of claim 20 wherein the first end is adapted to be permanently attached to a support member of an infant leisure device.

22. The activity fastener of claim 20 further comprising a toy secured within the loop portion.

23. The activity fastener of claim 20 wherein the threshold value is less than a weight of the infant.

24. The activity fastener of claim 20 wherein the threshold value is less than seven pounds.

25. An infant activity device comprising:

a base;

an upper member;

a pad disposed over a portion of the upper member; and an activity fastener attached to a surface of, the upper member with the activity fastener comprising:

a flexible strip having a first end attachable to a support member of the infant leisure device, a second free end; and a hook and loop type fastener for attaching the second end to the flexible strip to form a loop portion the hook and loop type fastener detaching the second end from the flexible strip when subjected to a load greater than a threshold value to avoid injury to the infant.

26. The infant activity device of claim 25 wherein the upper member is a portion of a collapsible rail that encloses an area about the base.

27. The infant activity device of claim 25 wherein the upper member is a fixed and un-collapsible portion of the collapsible rail.

28. An infant activity device, comprising:

a base;

an upper member supported above the base; and a removable panel attached to at least one of the base and the upper member, the removable panel being reversible between a first orientation and a second orientation, the removable panel including:

a first major surface having a first visual exhibit that faces the infant in the first orientation, and a second major surface having a second different visual exhibit that faces the infant in the second orientation, an activity fastener comprising:

a flexible strip having a first end attachable to a support member of the infant leisure device, a second free end; and a hook and loop type fastener for attaching the second end to the flexible strip to form a loop portion the hook and loop type fastener detaching the second end from the flexible strip when subjected to a load greater than a threshold value to avoid injury to the infant.

* * * * *